US010563570B2

(12) United States Patent
Kennedy et al.

(10) Patent No.: US 10,563,570 B2
(45) Date of Patent: Feb. 18, 2020

(54) HIGH TEMPERATURE CAPABLE JOINT ASSEMBLY FOR USE IN AIR-TO-AIR AFTERCOOLERS (ATAAC)

(71) Applicant: Caterpillar Inc., Peoria, IL (US)

(72) Inventors: Joseph L Kennedy, Peoria, IL (US); James M. Voelker, Metamora, IL (US); Nirag Sheth, Peoria, IL (US); Neil A. Terry, Edelstein, IL (US)

(73) Assignee: Caterpillar Inc., Peoria, IL (US)

( * ) Notice: Subject to any disclaimer, the term of this patent is extended or adjusted under 35 U.S.C. 154(b) by 347 days.

(21) Appl. No.: 15/689,011

(22) Filed: Aug. 29, 2017

(65) Prior Publication Data

US 2019/0063305 A1 Feb. 28, 2019

(51) Int. Cl.
*F02B 29/04* (2006.01)
*F28D 1/04* (2006.01)

(52) U.S. Cl.
CPC ..... *F02B 29/0456* (2013.01); *F28D 1/0417* (2013.01)

(58) Field of Classification Search
CPC ..... F02B 29/0456; F28D 1/0417; F28D 1/05366; F28D 2021/0082; F28F 1/025; F28F 9/10; F28F 9/001; F28F 9/12; F28F 9/08
USPC ..... 60/599
See application file for complete search history.

(56) References Cited

U.S. PATENT DOCUMENTS

| | | | | |
|---|---|---|---|---|
| 3,074,748 | A * | 1/1963 | Ulrich | F16L 15/008 285/347 |
| 4,735,442 | A * | 4/1988 | Burli | B25B 27/10 285/148.13 |
| 5,348,082 | A | 9/1994 | Velluet et al. | |
| 5,730,213 | A | 3/1998 | Kiser et al. | |
| 7,971,909 | B2 | 7/2011 | Nakata et al. | |
| 8,251,134 | B2 * | 8/2012 | Janezich | F28F 9/06 165/158 |
| 9,015,923 | B2 | 4/2015 | Lindell et al. | |
| 2004/0183303 | A1 | 9/2004 | Westermann | |
| 2008/0216989 | A1 | 9/2008 | Grajzi | |
| 2010/0201124 | A1 | 8/2010 | Duquette et al. | |

(Continued)

FOREIGN PATENT DOCUMENTS

| | | |
|---|---|---|
| CN | 200940977 | 8/2007 |
| CN | 201740427 | 2/2011 |
| WO | 2014010673 | 1/2014 |

*Primary Examiner* — Phutthiwat Wongwian
*Assistant Examiner* — Edward Bushard

(57) ABSTRACT

The invention relates to an ATAAC having a header, a plurality of slots defined in the header, a plurality of core tubes coupled to the header, and a plurality of joint assemblies to couple the header with the plurality of core tubes. Each of the plurality of joint assemblies includes an adapter, a sleeve, and a nut. The adapter further includes a first section threadedly engaged with one of the plurality of slots. The adapter further includes a tapered section inserted inside a flared end portion of one of the plurality of core tubes. Furthermore, the adapter includes a second section defined between the tapered section and the first section. The sleeve disposed around the one of the plurality of core tubes, the sleeve is engaged with the flared end portion of the one of the plurality of core tubes. The nut is engaged with the sleeve and the second section of the adapter.

13 Claims, 9 Drawing Sheets

(56) References Cited

U.S. PATENT DOCUMENTS

| | | | |
|---|---|---|---|
| 2011/0056668 | A1 | 3/2011 | Taras et al. |
| 2011/0253356 | A1 | 10/2011 | Williams |

* cited by examiner

HIGH TEMPERATURE CAPABLE JOINT ASSEMBLY FOR USE IN AIR-TO-AIR AFTERCOOLERS (ATAAC)

CROSS-REFERENCE TO RELATED APPLICATIONS

This application is a continuation-in-part of application Ser. No. 15/426,595, filed on Feb. 7, 2017.

TECHNICAL FIELD

The present disclosure generally relates to an air-to-air aftercooler (ATAAC) for an engine and, more specifically, to an ATAAC having high temperature capable tube-to-header joint assemblies.

BACKGROUND

Engine systems for many machines, and equipment include an air intake system that delivers intake air to an internal combustion engine for combustion with fuel. The air intake system may include an air compressor that pressurizes the intake air to force more air into the engine for combustion. At higher engine power densities, the temperature of the compressed air at the compressor outlet may approach or even exceed 350° C.

To cool the compressed air before introduction into the engine, the air intake system may also include an air-to-air aftercooler (ATAAC) disposed downstream of the air compressor. The ATAAC may include an inlet end (or a hot end) from where the hot compressed air enters the ATAAC, an outlet end (or a cold end) where the cooled compressed air exits the ATAAC. A typical ATAAC includes a plurality of core tubes that are coupled to headers disposed at both the cold end and the hot end. Usually, the plurality of core tubes are coupled to the headers through a grommet joint. Such grommet joints use rubber composite grommets to couple the plurality of core tubes to the headers. At temperatures greater than 350 degrees, the integrity of the rubber composite grommets (used in the grommet joint) may get compromised, therefore, compromising the integrity of the joint between the plurality of core tubes and the headers, which may be undesirable.

U.S. Pat. No. 7,971,909 discloses a pipe joint and a method of joining pipes using a pipe joint. The pipe joint includes a joint body, a fastening member such as a nut, and a sleeve. The sleeve is integrated with the fastening member or the joint body before the fastening member is attached to the joint body. When the fastening member is attached to the joint body, the sleeve is cut off and separated from the fastening member or joint body. When the nut is fully attached, the sleeve bites into the pipe, and the pipe is joined to the joint body.

SUMMARY

In accordance with an aspect of the present disclosure an air-to-air aftercooler (ATAAC) for an engine system is disclosed. The ATAAC includes a header, disposed at an end of the ATAAC, adapted to receive hot air, the header comprising a first surface, a second surface, and defining a plurality of slots extending from the first surface to the second surface. Further, the ATAAC includes a plurality of core tubes, each of the plurality of core tubes having a flared end portion. The plurality of core tubes are coupled with the header through a plurality of joint assemblies each of the plurality of joint assemblies includes an adapter. The adapter further includes a first section threadedly engaged with one of the plurality of slots. The adapter further includes a tapered section inserted inside the flared end portion of one of the plurality of core tubes. Furthermore, the adapter includes a second section defined between the tapered section and the first section. Additionally, each of plurality of joint assemblies a sleeve disposed around the one of the plurality of core tubes, the sleeve is engaged with the flared end portion of the one of the plurality of core tubes. Further, each of the joint assembly includes a nut engaged with the sleeve and the second section of the adapter, wherein the engagement of the nut with the sleeve and the second section facilitates retention of the tapered section of the adapter within the flared end portion of the one of the plurality of core tubes.

In accordance with an aspect of the present disclosure an engine system is disclosed. The engine system includes an engine, a compressor coupled upstream of the engine and is configured to provide compressed air to the engine. Further, the engine system includes an air-to-air aftercooler (ATAAC) coupled downstream of the compressor and upstream of the engine. The ATAAC includes a header, disposed at an end of the ATAAC, adapted to receive hot air, the header comprising a first surface, a second surface, and defining a plurality of slots extending from the first surface to the second surface. Further, the ATAAC includes a plurality of core tubes, each of the plurality of core tubes having a flared end portion. The plurality of core tubes are coupled with the header through a plurality of joint assemblies each of the plurality of joint assemblies includes an adapter. The adapter further includes a first section threadedly engaged with one of the plurality of slots. The adapter further includes a tapered section inserted inside the flared end portion of one of the plurality of core tubes. Furthermore, the adapter includes a second section defined between the tapered section and the first section. Additionally, each of plurality ofjoint assemblies a sleeve disposed around the one of the plurality of core tubes, the sleeve is engaged with the flared end portion of the one of the plurality of core tubes. Further, each of the joint assembly includes a nut engaged with the sleeve and the second section of the adapter, wherein the engagement of the nut with the sleeve and the second section facilitates retention of the tapered section of the adapter within the flared end portion of the one of the plurality of core tubes.

In accordance with an aspect of the present disclosure a method of connecting a core tube to a header disposed at an end of an air-to-air aftercooler (ATAAC) is disclosed. The method includes threadedly engaging a first section of an adapter to a slot defined in the header. Further, the method includes receiving a nut around the core tube. Furthermore, the method includes disposing a sleeve around the core tube, wherein the nut engages with the sleeve, wherein the nut and the sleeve are slidable with respect to the sleeve. Thereafter, the method includes flaring a first end of the core tube to form a flared end portion of the core tube. The method further includes inserting a tapered section of the adapter in the flared end portion of the core tube. Additionally, the method includes threadedly engaging the nut with a second section of the adapter to engage the nut with the sleeve, wherein the engagement of the nut with the sleeve facilitates engagement of the sleeve with the flared end portion to retains the adapter engaged with the flared end portion of the core tube.

DETAILED DESCRIPTION

Figure 1:
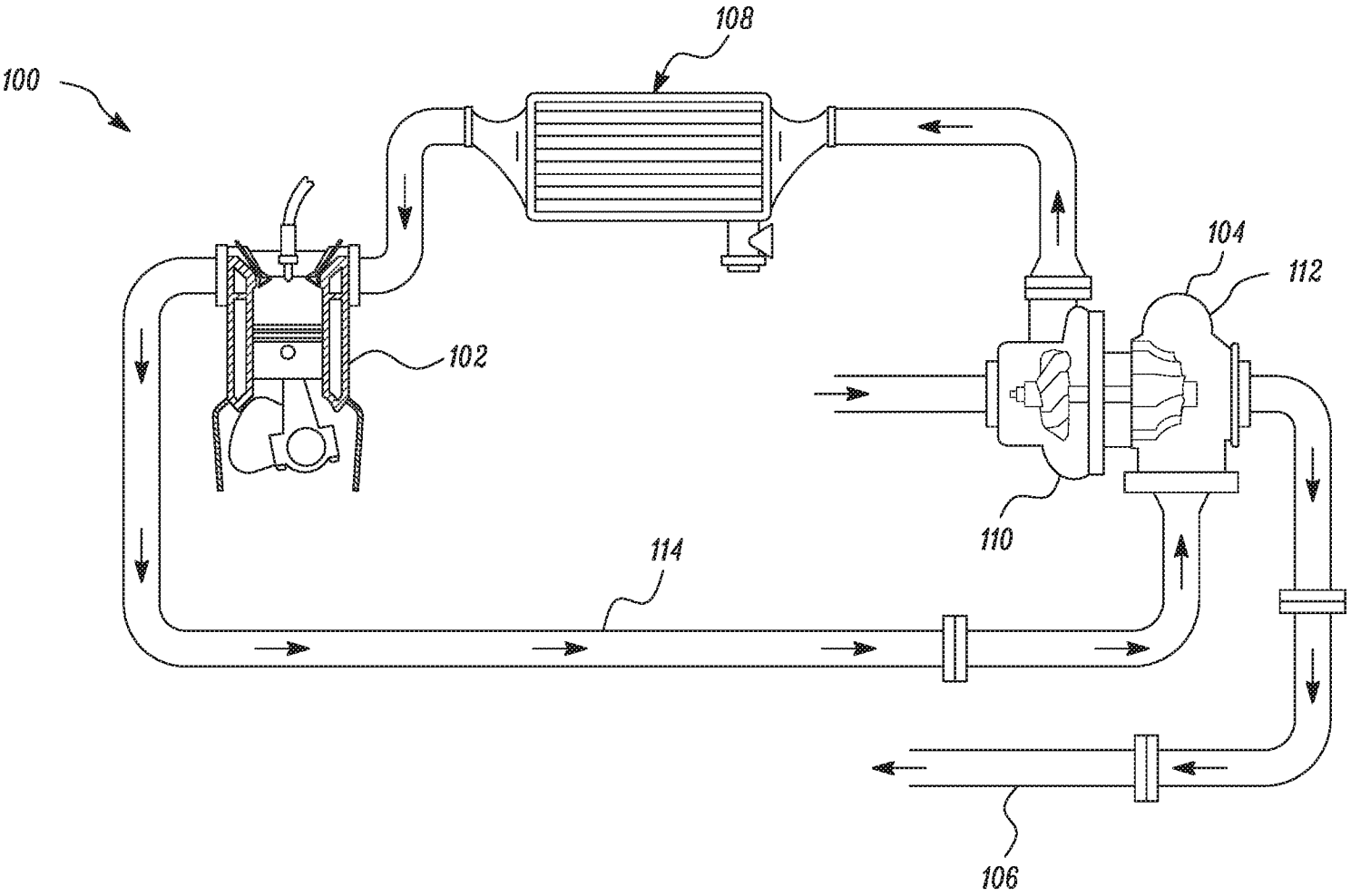
FIG. 1 illustrates a schematic of an exemplary engine system, in accordance with the present disclosure.

Referring to FIG. 1 an engine system 100 is illustrated. The engine system 100 may be applied in a variety of machines, such as, but not limited to, excavators, loaders, dozers, compactors, paving machines, draglines, off-highway trucks, mining trucks, locomotives, and similar other machines, such as those that are applicable in a construction industry, including autonomous machines and semi-autonomous machines. In some implementations, aspects of the present disclosure may be extended to stationary power generating machines, and to machines that are applied in commercial and domestic environments. The engine system 100 includes an engine 102, a turbocharger 104, an exhaust conduit 106, and an aftercooler 108. The turbocharger 104 further includes a compressor 110 and a turbine 112.

The engine 102 may be configured to receive a fuel, such as natural gas (or any of one or more components of natural gas), diesel, or hydrogen ($H_2$), for combustion. The engine 102 may ignite the fuel to generate energy, which is thereafter used to power various components of the machine in which the engine 102 is used. The ignition of the fuel generates exhaust gases, which are communicated to the turbine 112 of the turbocharger 104 through a conduit 114. The exhaust gases drive an impeller (not shown) of the turbine 112 of the turbocharger 104. The impeller of the turbine 112 is coupled to the compressor 110 through a shaft. The movement of the impeller of the turbine 112 causes the compressor 110 to operate. The compressor 110 compresses the air from the ambient and delivers the compressed air to the engine 102 through the aftercooler 108. The aftercooler 108 may correspond to a heat exchanger that is configured to cool the compressed air before the compressed air is delivered to the engine 102. Some examples of the aftercooler 108 may include, but are not limited to, air-to-air aftercooler (ATAAC), radiator, and/or the like. For the purpose of the ongoing description, the aftercooler 108 has been considered as the ATAAC 108. The structure of the ATAAC 108 will be described in conjunction with FIG. 2.

Figure 2:
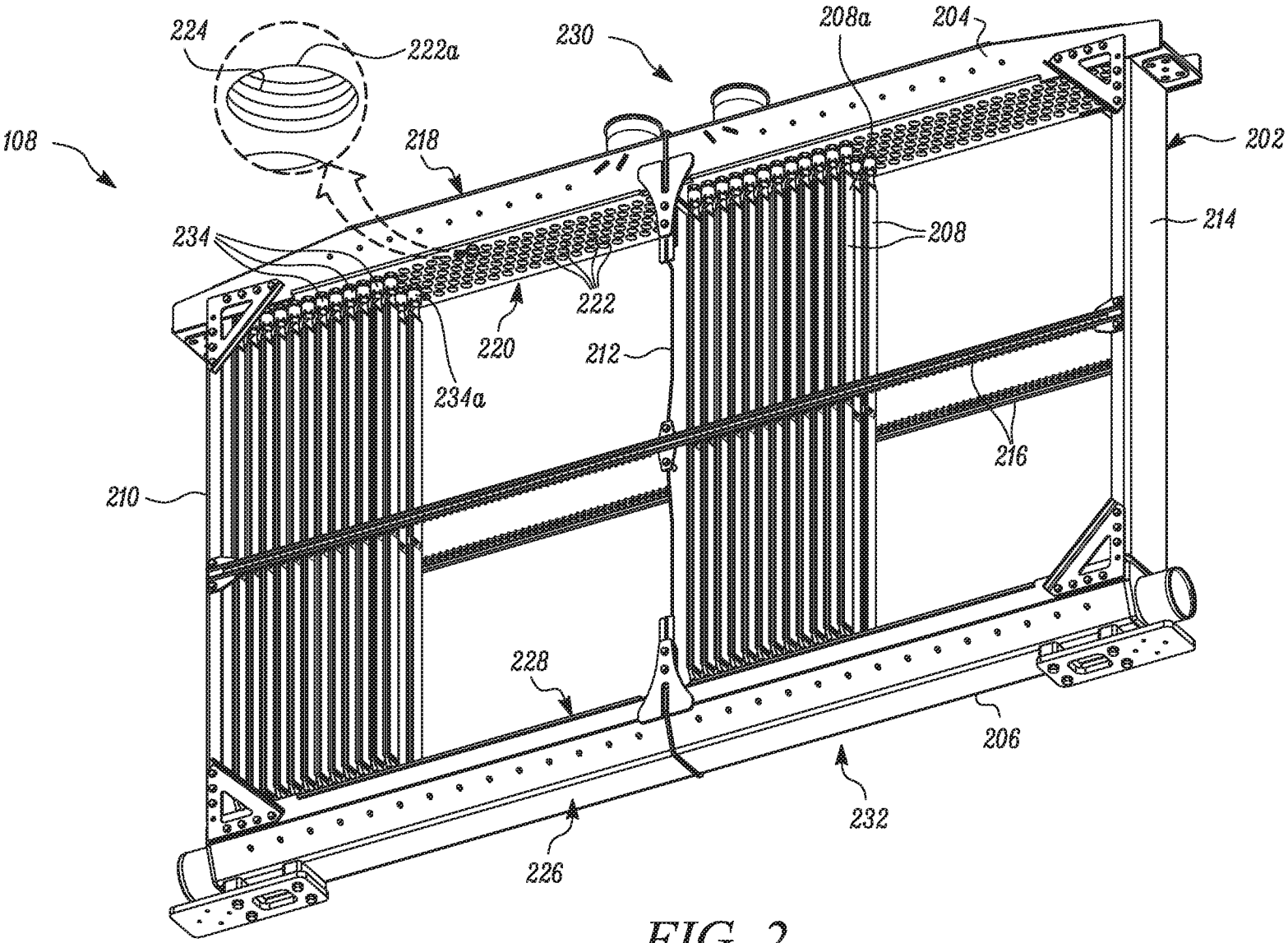
FIG. 2 illustrates a perspective view of an air-to-air aftercooler (ATAAC), in accordance with the present disclosure.

Referring to FIG. 2 a perspective view of the ATAAC 108 is illustrated. The ATAAC 108 includes a frame 202, a first header 204, a second header 206, and a plurality of core tubes 208. The frame 202 includes a first member 210, a second member 212, a third member 214, and a pair of fourth members 216. The first member 210, the second member 212, and the third member 214 extend between the first header 204 and the second header 206. In an embodiment, the first member 210, the second member 212, and the third member 214 are equally spaced apart along a length of the first header 204 and the second header 206, and are substantially parallel to each other. Further, each of the first member 210, the second member 212, and the third member 214 is substantially perpendicular to the first header 204 and the second header 206. The pair of fourth members 216 is coupled to each of the first member 210, the second member 212, and the third member 214. Further, the pair of fourth members 216 is placed substantially parallel to the first header 204 and the second header 206, and is equally spaced apart from the first header 204 and the second header 206.

The first header 204 includes a first surface 218 and a second surface 220. The first header 204 is placed in the ATAAC 108 in such a manner that the second surface 220 is proximal to the second header 206 and the first surface 218 is distal from the second header 206. Further, first header 204 includes a plurality of slots 222 that extend from the second surface 220 of the first header 204 to the first surface 218 of the first header 204. In an embodiment, each of the plurality of slots 222 has a circular cross section and has an inner surface224 that is threaded (represented by 226). In an embodiment, the threads 224 defined on the inner surface 224 of each of the plurality of slots 222 correspond to pipe threads.

Similar to the first header 204, the second header 206 also has a first surface 226 and a second surface 228. The second header 206 is placed in the ATAAC 108 in such a manner that the second surface 228 is proximal to the first header 204 and the first surface 226 is distal from the first header 204. Further, similar to the first header 204, the second header 206 includes a plurality of slots (not shown) that extend from the second surface 228 of the second header 206 to the first surface 226 of the second header 206. In an embodiment, the plurality of slots defined in the second header 206 has an inner surface that is non-threaded. In an embodiment, the first header 204 defines a first end 230 of the ATAAC 108, and the second header 206 defines a second end 232 of the ATAAC 108. The first header 204, disposed at the first end 230 of the ATAAC 108, is configured to receive hot compressed air from the compressor 110. The second header 206, disposed at the second end 232 of the ATAAC 108, is configured to provide cooled compressed air to the engine 102. Therefore, the first end 230 of the ATAAC 108 and the second end 232 of the ATAAC 108 may correspond to a hot end 230 and a cold end 232 of the ATAAC 108, respectively.

Figure 3:
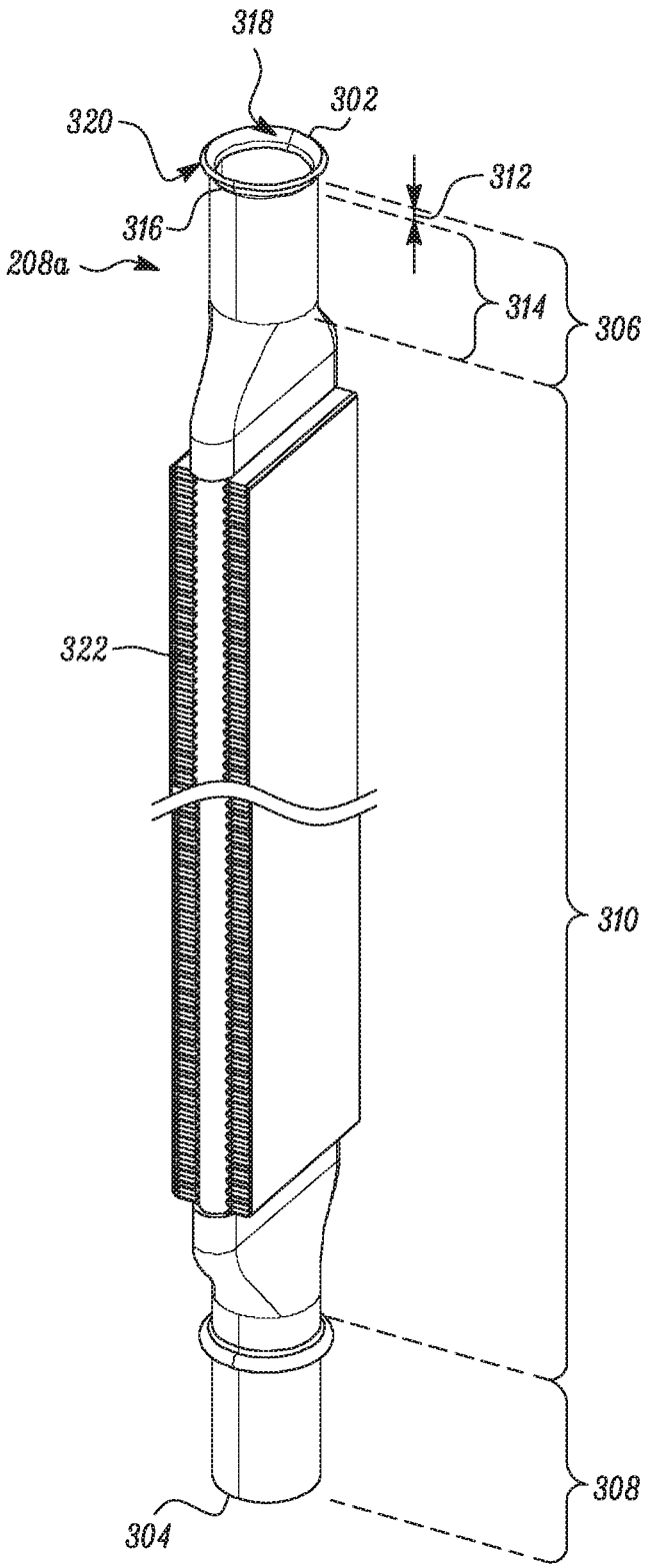
FIG. 3 illustrates a sectional perspective view of a core tube, in accordance with the present disclosure.

The process of cooling the hot compressed air is performed by the plurality of core tubes 208 coupled to the first header 204 of the ATAAC 108 and the second header 206 of the ATAAC 108 through the plurality of first joint assemblies 234 and a plurality of second joint assemblies (not shown). Referring to FIG. 3, a sectional perspective view of a core tube 208*a* of the plurality of core tubes 208, is illustrated. The core tube 208*a* includes a first end 302, a second end 304, a first section 306, a second section 308, and a center portion 310 defined between the first section 306 and the second section 308. Further, the first section 306 includes a flared end portion 312 and a tube portion 314. The flared end portion 312 extends axially from the first end 302 of the core tube 208*a* to the tube portion 314 and may be formed by flaring a portion of the first section 306. Therefore, an inner diameter of the flared end portion 312 increases along an axial direction from the tube portion 314 to the first end 302. Therefore, the flared end portion 312 has a maximum inner diameter at the first end 302 and a minimum inner diameter at a junction 316 of the flared end portion 312 and the tube portion 314. The flared end portion 312 has an inner surface 318 and an outer surface 320.

The tube portion 314 of the first section 306 extends axially from the junction 316 (i.e., the junction of the flared end portion 312 and the tube portion 314) to the center portion 310. In an embodiment, the tube portion 314 may have a circular cross-sectional shape. Further, the center portion 310 of the core tube 208*a* may have an oval cross-sectional shape. In an embodiment, the center portion 310 of the core tube 208*a* may include fins 322 that facilitate heat exchange between the hot compressed air (received from the compressor 110) flowing through the core tube 208*a*, and the ambient air flowing outside of the core tube 208*a*. It may be contemplated that other core tubes of the plurality of core tubes 208 may have a similar structure to that of the core tube 208*a*.

The second section 308 extends axially from the center portion 310 to the second end 304. The second end 304 is coupled to the plurality of slots defined in the second header 206. Further, the first end 302 of the core tube 208*a* is coupled to first header 204 at a slot 222*a* through a joint assembly 234*a* of the plurality of first joint assemblies 234. The structure of the joint assembly 234*a* has been described in conjunction with FIG. 4 and FIG. 5.

Figure 4:
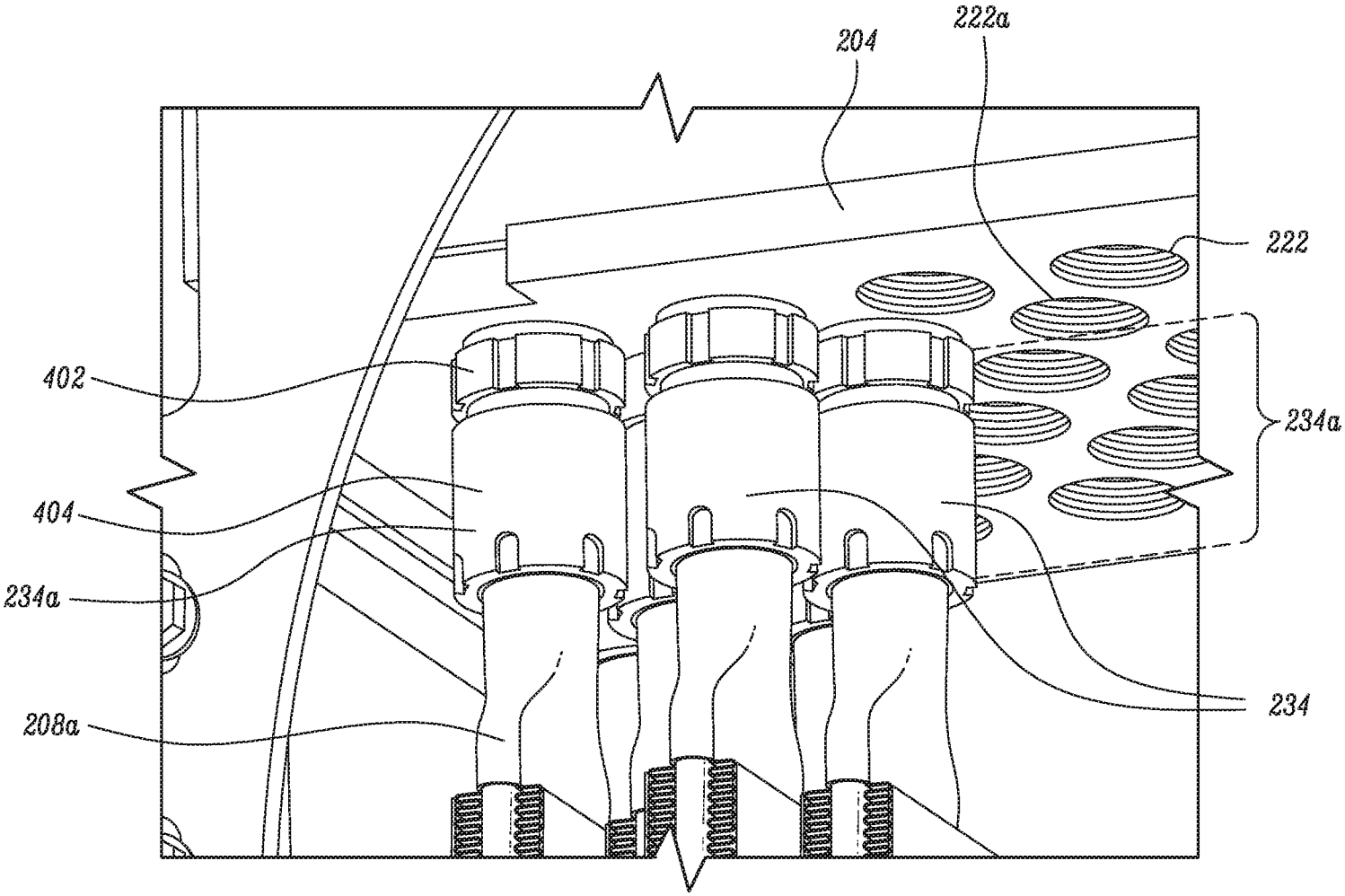
FIG. 4 illustrates a perspective view of the core tube coupled to the first header of the ATAAC, in accordance with the present disclosure.
Figure 5:
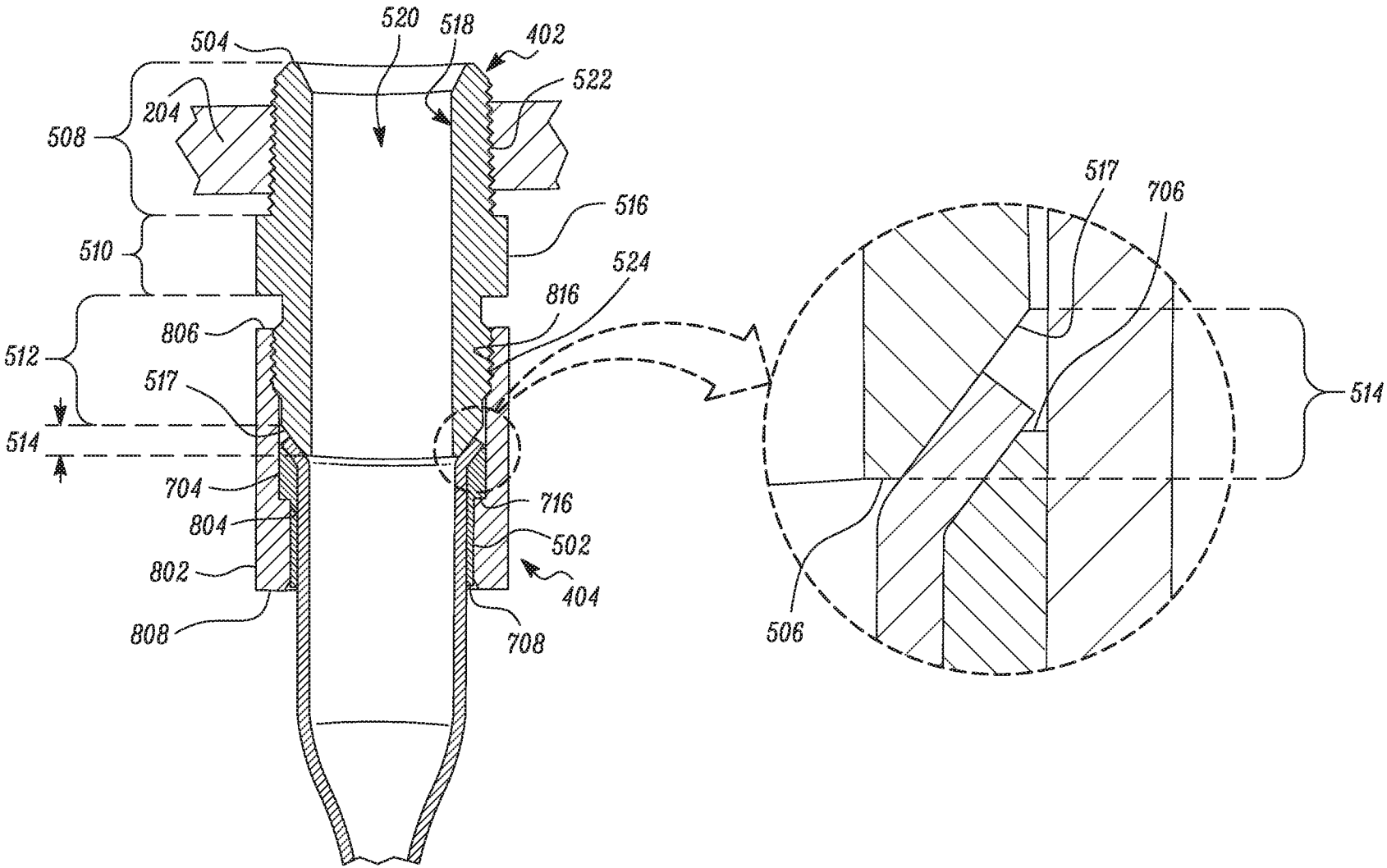
FIG. 5 illustrates a perspective view of the core tube coupled to the first header of the ATAAC, in accordance with the present disclosure.

Referring to FIG. 4 and FIG. 5, a perspective view and a sectional view of the core tube 208*a* coupled to the first header 204 through the joint assembly 234*a*, are illustrated. The joint assembly 234*a* includes an adapter 402, a sleeve 502 (refer FIG. 5), and a nut 404.

Figure 6:
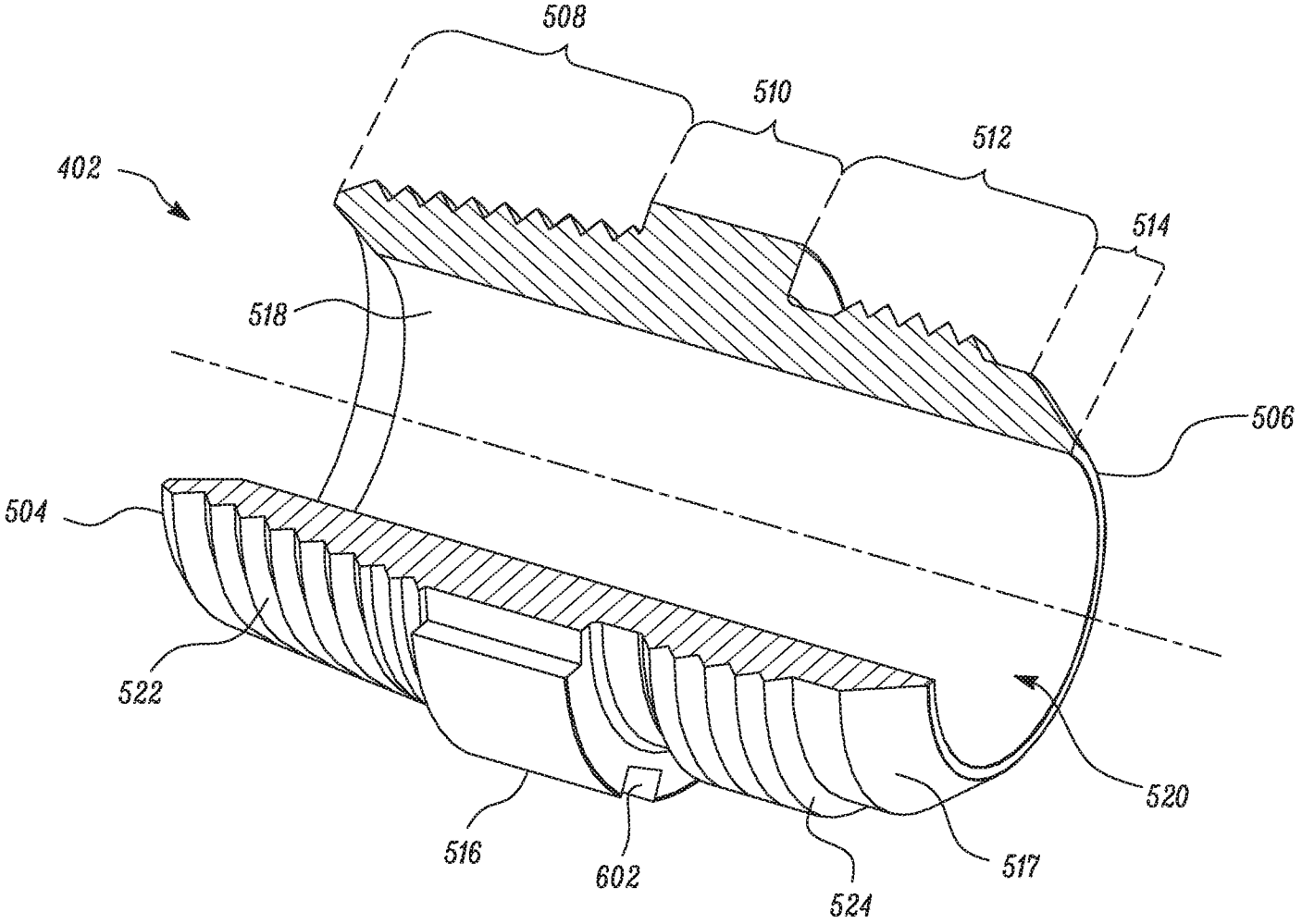
FIG. 6 illustrates a sectional perspective view of an adapter, in accordance with the present disclosure.

Referring to FIG. 5 and FIG. 6, the adapter 402 includes a first end 504, a second end 506, a first section 508, a flange section 510, a second section 512, and a tapered section 514. Further, the adapter 402 has an outer periphery 516 and an inner periphery 518. The inner periphery 518 of the adapter 402 defines a channel 520.

The first section 508 of the adapter 402 extends axially from the first end 504 to the flange section 510. Further, the outer periphery 516 of the adapter 402 at the first section 508 is threaded (represented by 522) and is configured to engage with one of the plurality of slots 222 defined in the first header 204. FIG. 5 illustrates the engagement of the first section 508 of the adapter 402 with the slot 222*a* defined in the first header 204. In an embodiment, the threads 522 defined on the outer periphery 516 of the adapter 402 at the first section 508 correspond to pipe threads.

The flange section 510 of the adapter 402 extends axially from the first section 508 of the adapter 402 to the second section 512 of the adapter 402. In an embodiment, an outer diameter of the adapter 402 at the flange section 510 is greater than an outer diameter at other sections of the adapter 402. For example, the outer diameter at the flange section 510 of the adapter 402 is greater than the outer diameter of the adapter 402 at the first section 508. Further, the outer periphery 516 of the adapter 402 at the flange section 510 defines a plurality of grooves 602 that extend axially along a length of the flange section 510. The plurality of grooves 602 enables the usage of a fastening tool (e.g., a wrench) to fasten the first section 508 of the adapter 402 with the plurality of slots 222.

The second section 512 of the adapter 402 extends axially from the flange section 510 of the adapter 402 to the tapered section 514 of the adapter 402. In an embodiment, the outer periphery 516 of the adapter 402 at the second section 512 is threaded (represented by 524). In an embodiment, the threads 524 formed on the outer periphery of the second section 512 of the adapter 402 is different from the threads 522. For example, the threads 522 corresponds to the pipe threads and the threads 524 corresponds to non-pipe threads.

The tapered section 514 extends axially from the second section 512 to the second end 506 of the adapter 402. In an embodiment, an outer diameter of the adapter 402 in the tapered section 514 decreases along the axial direction from the second section 512, to the second end 506. Therefore, the outer diameter of the adapter 402 at the junction of the tapered section 514 and the second section 512 is greater than the outer diameter of adapter 402 at the second end 506. The tapered section 514 of the adapter 402 is inserted inside the flared end portion 312 of the core tube 208*a* such that an outer surface 517 of the tapered section 514 abuts the inner surface 318 of the flared end portion 312 of the core tube 208*a*.

Figure 7:
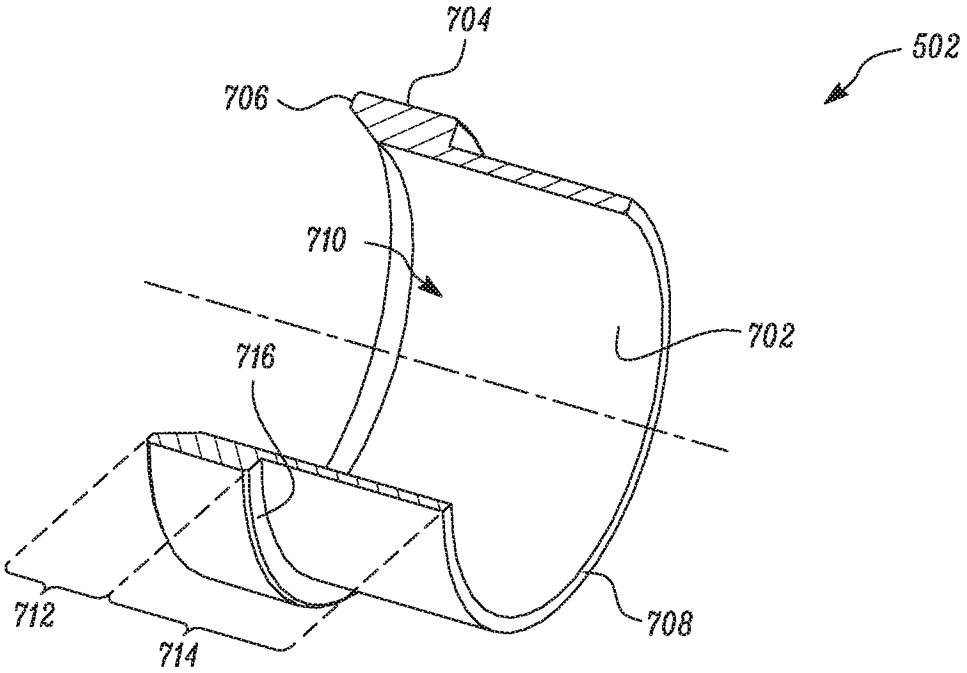
FIG. 7 illustrates a sectional perspective view of a sleeve, in accordance with the present disclosure.

The sleeve 502 of the joint assembly 234*a* is disposed (see FIG. 5) around the core tube 208*a*. The sleeve 502 will further described on conjunction with FIG. 7. FIG. 7 illustrates sectional perspective view of the sleeve 502. The sleeve 502 includes an inner periphery 702, an outer periphery 704, a first end 706, and a second end 708. The inner periphery 702 of the sleeve 502 defines a bore 710. The inner diameter of the sleeve 502 (i.e., the diameter of the bore 710) is substantially equal to an outer diameter of the tube portion 314 of the core tube 208*a*. In an embodiment, the sleeve 502 may be slidable on the tube portion 314 of the core tube 208*a*. The first end 706 of the sleeve 502 is configured to engage with the outer surface 320 of the flared end portion 312 of the core tube 208*a*.

In an embodiment, the sleeve 502 may include a first portion 712 and a second portion 714. The first portion 712 extends axially from the first end 706 of the sleeve 502 to the second portion 714. Further, the second portion 714 of the sleeve 502 extends axially from the first portion 712 of the sleeve 502 to the second end 708. In an embodiment, an outer diameter of the first portion 712 is greater than the outer diameter of the second portion 714. Accordingly, a step 716 is defined at a junction of the first portion 712 and the second portion 714.

Figure 8:
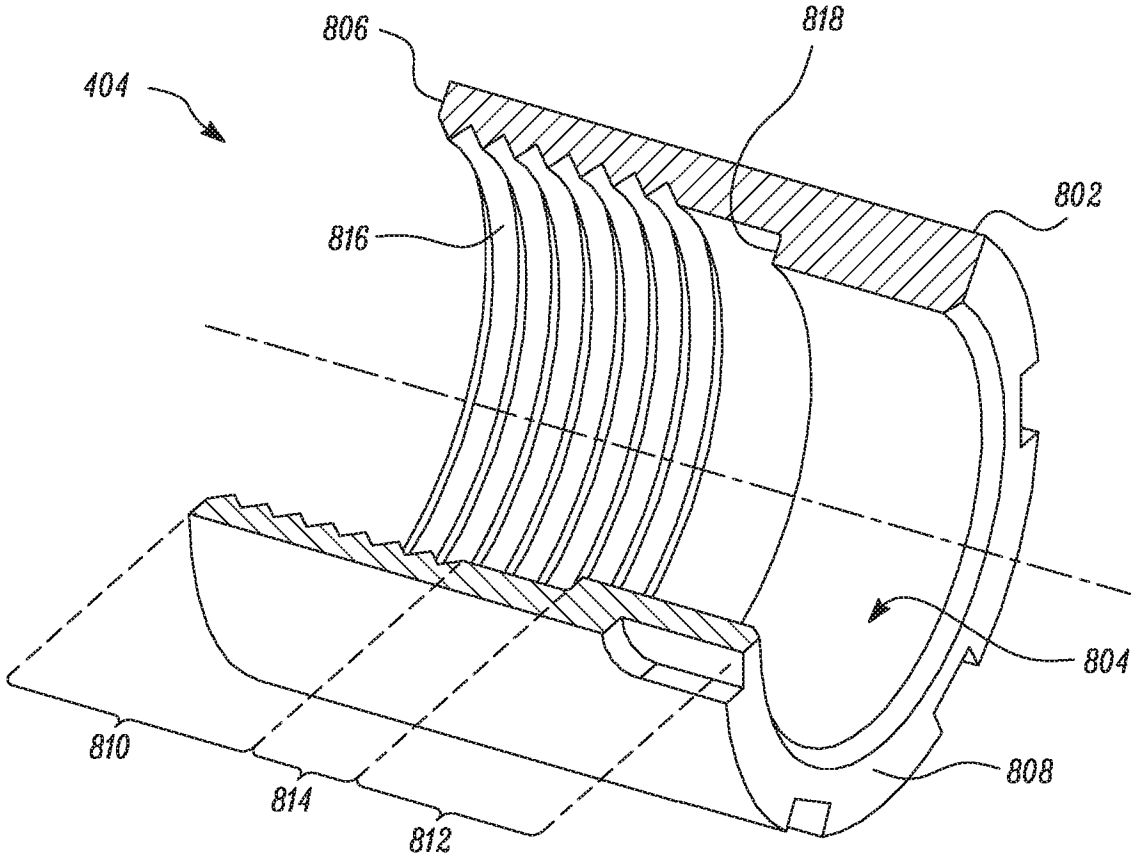
FIG. 8 illustrates a sectional perspective view of a nut, in accordance with the present disclosure.

Referring back to FIG. 5, the nut 404 of the joint assembly 234*a* is partially disposed around the sleeve 502 and the core tube 208*a*. Referring to FIG. 8, the nut 404 includes an outer periphery 802, an inner periphery 804, a first end 806, and a second end 808. Additionally, the nut 404 includes a first structure 810, a second structure 812, and a third structure 814 defined on the inner periphery 804.

The first structure 810 of the nut 404 extends axially from the first end 806 to the third structure 814. Further, the first structure 810 of the nut 404 is threaded (represented by 816) and is configured to engage with the second section 512 of the adapter 402. The threads 816 are defined on the inner periphery 804 of the nut 404. Further, the type of the threads 816 defined on the inner periphery 804 of the nut 404 is of the same type as that of the threads 524 defined in the second section 512 of the adapter 402.

The third structure 814 extends axially from the first structure 810 to the second structure 812. In an embodiment, an inner diameter of the third structure 814 is same as an inner diameter of the first structure 810. Further, the inner periphery 804 of the nut 404 at the third structure 814 is non-threaded.

The second structure 812 extends axially from the third structure 814 to the second end 808 of the nut 404. An inner diameter of the of the second structure 812 is less than the inner diameter of the first structure 810 and the third structure 814. Therefore, a step 818 is defined at a junction of the second structure 812 and the third structure 814.

To couple the core tube 208*a* with the slot 222*a*, the first section 508 of the adapter 402 is threadedly engaged with the slot 222*a* (through threaded engagement between the threads defined in the slot 222*a* and the threads 522 on the first section 508 of the adapter 402). Thereafter, the core tube 208*a* is engaged with the adapter 402 in such a manner that the tapered section 514 of the adapter 402 is inserted into the flared end portion 312 of the core tube 208*a*. The inner surface 318 of the flared end portion 312 abuts the outer periphery 516 of the adapter 402 at the tapered section 514. Further, to engage the core tube 208*a* with the adapter 402, the nut 404 (disposed on the sleeve 502) is threadedly engaged with the second section 512 of the adapter 402. When the nut 404 engages with the second section 512 of the adapter 402, the step 818 (defined on the inner periphery 804 of the nut 404) abuts with the step 716 defined on the outer periphery 704 of the sleeve 502. Such an abutment of the step 818 with the step 716, and further movement (towards the first end 302 of the core tube 208*a*) of the nut 404 relative to the second section 512 of the adapter 402, causes a portion of the sleeve 502 to be pushed over and engaged with the flared end portion 312 of the core tube 208*a*. The engagement of the sleeve 502 with the flared end portion 312 facilitates retention and abutment of the tapered section 514 of the adapter 402 with the flared end portion 312 of the core tube 208*a*, and thereby helps in forming a metal to metal seal between the flared end portion 312 and the tapered section 514.

INDUSTRIAL APPLICABILITY

Figure 9:
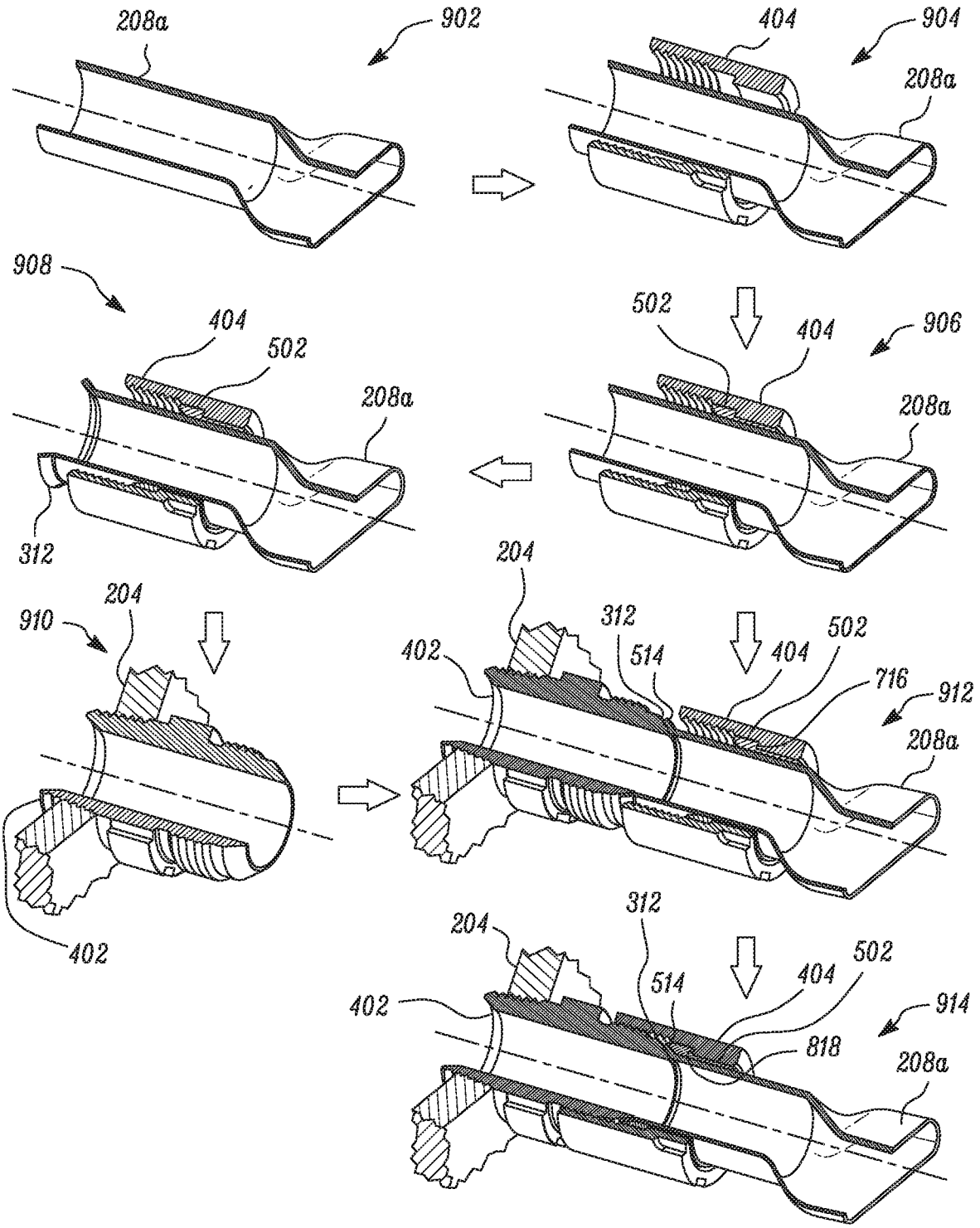
FIG. 9 illustrates a flow diagram illustrating a method for coupling the core tube with the first header of the ATAAC, in accordance with the present disclosure.

Referring to FIG. 9 a flow diagram 900 illustrating a method for assembling the ATAAC 108, is illustrated. At stage 902, the core tube 208*a* is provided. Initially, none of the ends (i.e., the first end 302 and the second end 304) is unflared, i.e., the inner diameter of the core tube 208*a* in the first section 306 is constant. At stage 904, the nut 404 is disposed around the core tube 208*a*. In an embodiment, the nut 404 is slidable along a length of the first section 306. Thereafter, at stage 906, the sleeve 502 is disposed around the first section 306 of the core tube 208*a*. The step 716 of the sleeve 502 engages/abuts the step 818 of the nut 404. Therefore, when the nut 404 is slides along the length of the first section 306 of the core tube 208*a*, the sleeve 502 also slides along with the nut 404

At stage 908, the first end 302 of the core tube 208*a* is flared using one or more known technologies to form the flared end portion 312. At stage 910, the first section 508 of the adapter 402 is threadedly engaged with the slot 222*a* of the plurality of slots 222 defined in the first header 204. Further, at stage 912, the tapered section 514 of the adapter 402 is inserted in the flared end portion 312 of the core tube 208*a*.

At 914, the nut 404 is threadably engaged with the second section 512 of the adapter 402. In an embodiment, as the nut 404 is threadably engaged with the second section 512 of the adapter 402, the nut 404 moves towards the first end 504 of adapter 402, thereby causing sleeve 502 to slides towards the flared end portion 312 of the core tube 208*a*. Upon further threaded movement of the nut 404, the step 818 of the nut 404 pushes against the step 716 of the sleeve 502, causing the portion of the sleeve 502 to be positioned over a portion of the flared end portion 312 of the core tube 208*a* leading to engagement of the sleeve 502 with the flared end portion 312. The positioning and engagement of a portion of the sleeve 502 over a flared end portion 312 helps in achieving a metal to metal seal between the flared end portion 312 of the core tube 208*a* and the tapered section 514 of the adapter 402, achieving a leak proof joint. Further, as the pipe threads are utilized to attached the adapter 402 with the first header 204, a leak proof joint is formed between the adapter 402 and the first header 204. In this manner, each of the core tube 208*a* is coupled to the first header 204 resulting in ATAAC that can operate and handle compressed air having high temperature specifically compressed air having temperature above 300 degrees.

What is claimed is:

1. An air-to-air aftercooler (ATAAC) for an engine system, the ATAAC comprising:

a header, disposed at an end of the ATAAC, adapted to receive hot air, the header comprising a first surface, a second surface, and defining a plurality of slots extending from the first surface to the second surface;

a plurality of core tubes, each of the plurality of core tubes having a flared end portion; and a plurality of joint assemblies coupling each of the plurality of core tubes with the header, the each of plurality of joint assemblies comprising:

an adapter comprising:

a first section threadedly engaged with one of the plurality of slots, a tapered section inserted inside the flared end portion of one of the plurality of core tubes, and a second section defined between the tapered section and the first section, a sleeve disposed around the one of the plurality of core tubes, the sleeve is engaged with the flared end portion of the one of the plurality of core tubes, a nut engaged with the sleeve and the second section of the adapter, wherein the engagement of the nut with the sleeve and the second section facilitates retention of the tapered section of the adapter within the flared end portion of the one of the plurality of core tubes.

2. The ATAAC of claim 1, wherein the first section of the adapter has a pipe threads and the second section of the adapter has non-pipe threads.

3. The ATAAC of claim 1, wherein the flared end portion of the one of the plurality of core tubes has an inner surface, wherein the inner surface of the flared end portion abuts an outer surface of the adapter in the tapered section.

4. The ATAAC of claim 1, wherein the adapter further comprises a flange section defined between the first section and the second section.

5. The ATAAC of claim 1, wherein the sleeve comprises a first portion engaged with the flared end portion and a second portion, the first portion having an outer diameter larger than an outer diameter of the second portion to define a first step between the first portion and the second portion.

6. The ATAAC of claim 5, wherein the nut comprises:

a first structure having inner threads engaged with the second section of the adapter; and a second structure having an inner diameter smaller than an inner diameter of the first structure to define a second step between the first structure and the second structure, wherein the second structure engages the first portion of the sleeve such that the second step abuts the first step.

7. An engine system, comprising:

an engine;

a compressor coupled upstream of the engine and is configured to provide compressed air to the engine;

an air-to-air aftercooler (ATAAC) coupled downstream of the compressor and upstream of the engine, the ATAAC comprising:

a header, disposed at an end of the ATAAC, adapted to receive hot air, the header comprising a first surface, a second surface, and defining a plurality of slots extending from the first surface to the second surface;

a plurality of core tubes, each of the plurality of core tubes having a flared end portion; and a plurality of joint assemblies coupling each of the plurality of core tubes with the header, the each of plurality of joint assemblies comprising:

an adapter comprising:

a first section threadedly engaged with one of the plurality of slots, a tapered section inserted inside the flared end portion of one of the plurality of core tubes, and a second section defined between the tapered section and the first section, a sleeve disposed around the one of the plurality of core tubes, the sleeve is engaged with the flared end portion of the one of the plurality of core tubes, a nut engaged with the sleeve and the second section of the adapter, wherein the engagement of the nut with the sleeve and the second section facilitates retention of the tapered section of the adapter within the flared end portion of the one of the plurality of core tubes.

8. The engine system of claim 7, wherein the first section of the adapter has a pipe threads and the second section of the adapter has non-pipe threads.

9. The engine system of claim 7, wherein the flared end portion of the one of the plurality of core tubes has an inner surface, wherein the inner surface of the flared end portion abuts an outer surface of the adapter in the tapered section.

10. The engine system of claim 7, wherein the adapter further comprises a flange section defined between the first section and the second section.

11. The engine system of claim 7, wherein the sleeve comprises a first portion engaged with the flared end portion and a second portion, the first portion having an outer diameter larger than an outer diameter of the second portion to define a first step between the first portion and the second portion.

12. The engine system of claim 11, wherein the nut comprises:

a first structure having inner threads engaged with the second section of the adapter; and a second structure having an inner diameter smaller than an inner diameter of the first structure to define a second step between the first structure and the second structure, wherein the second structure engages the first portion of the sleeve such that the second step abuts the first step.

13. A method of connecting a core tube to a header disposed at an end of an air-to-air aftercooler (ATAAC), the method comprising:

threadedly engaging a first section of an adapter to a slot defined in the header;

receiving a nut around the core tube;

disposing a sleeve around the core tube, wherein the nut engages with the sleeve, wherein the nut and the sleeve are slidable with respect to the sleeve;

flaring a first end of the core tube to form a flared end portion of the core tube;

inserting a tapered section of the adapter in the flared end portion of the core tube; and threadedly engaging the nut with a second section of the adapter to engage the nut with the sleeve, wherein the engagement of the nut with the sleeve facilitates engagement of the sleeve with the flared end portion to retains the adapter engaged with the flared end portion of the core tube.

* * * * *